US006807960B2

(12) United States Patent
Steck

(10) Patent No.: US 6,807,960 B2
(45) Date of Patent: Oct. 26, 2004

(54) TOOL FOR DRESSING PULPSTONES

(76) Inventor: Karl-Heinz Steck, KroKusweg 54 - D-89522, Heidenheim (DE)

( * ) Notice: Subject to any disclaimer, the term of this patent is extended or adjusted under 35 U.S.C. 154(b) by 0 days.

(21) Appl. No.: 10/062,935

(22) Filed: Jan. 31, 2002

(65) Prior Publication Data

US 2003/0145842 A1 Aug. 7, 2003

(51) Int. Cl.[7] ..... B28D 1/18
(52) U.S. Cl. ..... 125/5; 125/11.01
(58) Field of Search ..... 125/5, 11.01, 11.03, 125/11.02, 11.04; 451/56, 443, 540, 541, 542

(56) References Cited

U.S. PATENT DOCUMENTS

| | | | | |
|---|---|---|---|---|
| 1,118,671 A | * | 11/1914 | Millard | 125/11.03 |
| 1,268,624 A | * | 6/1918 | Riley | 125/11.03 |
| 3,132,815 A | * | 5/1964 | Wagner | 241/282.1 |
| 3,608,536 A | * | 9/1971 | Roberts, Jr. | 125/11.03 |
| 4,351,486 A | | 9/1982 | Schmoller et al. | |
| 5,243,789 A | | 9/1993 | Bacic | |
| 6,241,169 B1 | | 6/2001 | Bjorkqvist | |

OTHER PUBLICATIONS

Norton Excaliburr*
http://www.norton–canada.ca/pulpstone_info/index.html (pp. 1–25).

* cited by examiner

*Primary Examiner*—Dung Van Nguyen
(74) *Attorney, Agent, or Firm*—Mary E. Porter; Sampson & Associates, PC

(57) ABSTRACT

A burr is provided for dressing a grinding tool, such as the grinding surface of a pulpstone grinding tool used for mechanical preparation of wood pulp. The burr includes a cylindrical body portion, a plurality of teeth disposed on and protruding outward from the outer surface thereof, and at least one annular channel formed in the outer surface thereof. The burr may provide for a more uniform dress pattern in a grinding surface of a pulpstone grinding tool to provide improved consistency and quality of wood pulp produced thereby.

20 Claims, 5 Drawing Sheets

TOOL FOR DRESSING PULPSTONES

BACKGROUND OF THE INVENTION (1) Field of the Invention

The present invention relates generally to an apparatus and method for dressing grinding tools. This invention more particularly relates to a tool (i.e., a burr) and a method for dressing (also referred to as sharpening) pulpstone grinding tools used for the mechanical preparation of wood pulp. The tool of this invention advantageously may provide for both improved quality wood pulp and for a longer life pulpstone grinding tool.

(2) Background Information

The use of pulpstone grinding tools to grind wood (e.g., in the form of tree trunks or alternately in the form of chips) into fibrous wood pulp for the paper industry is well known. A typical pulpstone grinding tool is cylindrical in shape, and relatively large and complex, for example, including a diameter from about 120 to about 190 cm or more (about 48 to 75 inches) and a length from about 70 to about 230 cm or more (i.e., about 28 to 90 inches). A conventional pulpstone grinding tool typically includes a plurality of abrasive segments assembled about a cylindrical concrete core (see, for example, U.S. Pat. No. 5,243,789 to Bacic). The segments generally include a mixture of abrasive grains and bond material (e.g., ceramic, vitrified, or cement bond) pressed together into a desired shape.

In order to improve the grinding performance of conventional pulpstone grinding tools, the grinding surface thereof is typically dressed (also referred to as sharpened). Dressing generally includes applying a tool, referred to herein as a burr, to the pulpstone's grinding surface. For example, a burr may be rolled over the surface of the pulpstone grinding tool, under sufficient pressure to impart a pattern of impressions to the surface. A commercially available spiral burr (e.g., the 6×28 manufactured by Norton Canada, Inc., Hamilton, Ontario, Canada) may be used to impart a pattern of grooves and lands into the surface of the pulpstone grinding tool, as discussed in more detail hereinbelow.

The features of a typical burr affect the pattern in the grinding surface of a pulpstone grinding tool and therefore, affect the properties of the wood pulp produced thereby. For example, the fiber length of the wood pulp tends to be inversely related to the lead angle of a spiral burr used to dress the pulpstone grinding tool. Further, the features of the burr may impact the life of a pulpstone grinding tool and, therefore, may have a significant effect on the final cost of wood pulp. Therefore an improved dressing tool and/or an improved method for dressing the surface of a pulpstone grinding tool may provide for improved quality and/or reduced cost of wood pulp and may therefore be highly desirable by the paper and other wood pulp producing industries.

SUMMARY OF THE INVENTION

One aspect of the present invention includes a burr adapted for dressing a grinding surface of a grinding tool. The burr includes a cylindrical body portion having an outer surface, a plurality of teeth protruding radially outward from the outer surface, and at least one annular channel disposed in the outer surface. In one variation of this aspect, the burr is useful for dressing a grinding surface of a pulpstone grinding tool adapted for mechanical preparation of wood pulp.

In other aspect, this invention includes a burr for dressing a grinding surface of a pulpstone grinding tool adapted for mechanical preparation of wood pulp. The burr includes a cylindrical body portion having an outer surface, a length (axial dimension), and a longitudinal axis. The burr further includes a plurality of teeth extending radially outward from the outer surface and at least one annular channel disposed in the outer surface. The burr is useful for dressing a grinding surface of a pulpstone grinding tool adapted for mechanical preparation of wood pulp.

In still another aspect, this invention includes a method of fabricating a burr useful for dressing a grinding surface of a pulpstone grinding tool adapted for mechanical preparation of wood pulp. The method includes providing a cylindrical body portion having an outer surface, forming a plurality of teeth in the outer surface of the cylindrical body portion, and forming at least one annular channel in the outer surface of the cylindrical body portion.

In yet another aspect, this invention includes a method of dressing a grinding surface of a pulpstone grinding tool adapted for mechanical preparation of wood pulp. The method includes providing a burr including a cylindrical body portion having an outer surface, a plurality of teeth disposed on and protruding from the outer surface, and at least one annular channel disposed in the outer surface. The method further includes rotatably mounting the burr on an assembly adapted to traverse the length of the pulpstone grinding tool, pressing the burr into contact with the grinding surface of the pulpstone grinding tool, rotating the pulpstone grinding tool, so that the burr rolls over the grinding surface thereof, and traversing the burr along the length of the pulpstone grinding tool.

DETAILED DESCRIPTION

Figure 6A:
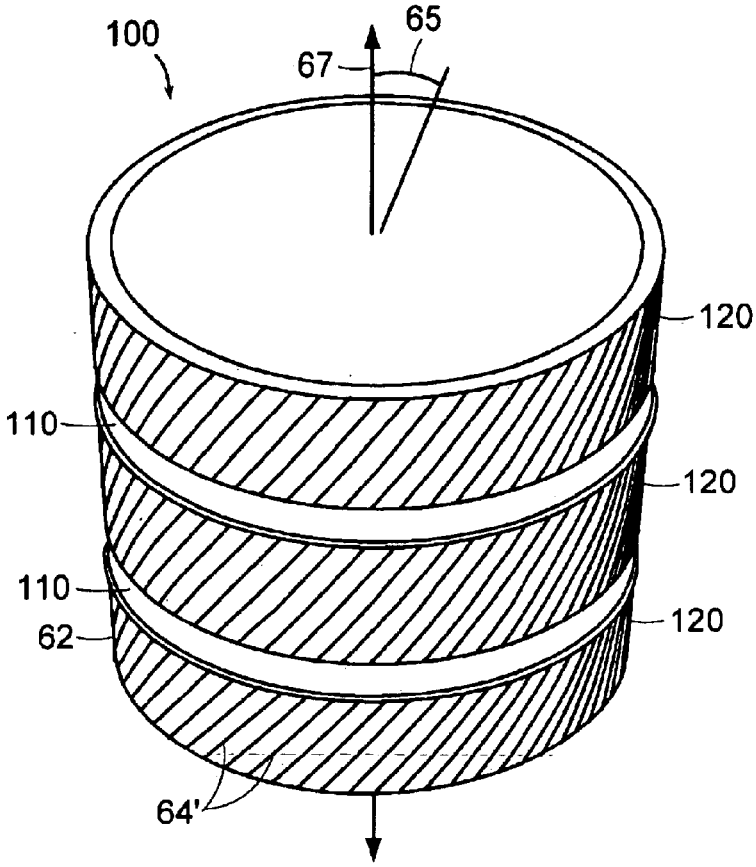
FIG. 6A is a perspective view of one embodiment of the dressing tool of this invention.
Figure 6B:
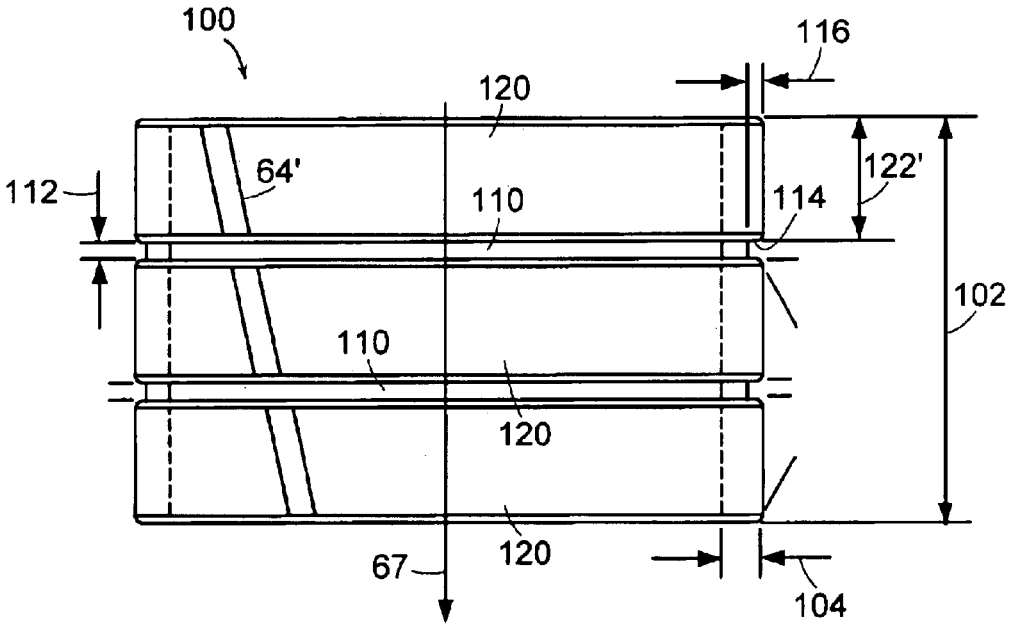
FIG. 6B is a side view of the dressing tool of FIG. 6A.

The present invention includes a burr (also referred to as a dressing tool) that may be useful in dressing and/or sharpening grinding tools (e.g., abrasive grinding wheels), and in particular pulpstone grinding tools that are used in the mechanical preparation of wood pulp. Referring to FIGS. 6A and 6B, a burr 100 of this invention includes a cylindrical body portion 63, typically in the form of a cylindrical ring or wheel, having teeth 64' disposed on an outer surface 62 thereof. The burr 100 further includes one or more annular channels 110 extending circumferentially about the body portion 63, which serve to separate the outer surface 62 into two or more surface regions 120. In one embodiment, burr 100 includes two channels 110, which effectively divide the outer surface 62 into three surface regions 120, which in particular embodiments, are of approximately equal axial dimension.

The burr of this invention is useful for dressing a grinding surface of a pulpstone grinding tool used for grinding wood pulp. Advantageously, teeth of the burr have been shown to exhibit reduced wear relative to those of a conventional burr. As a result, the burr of this invention tends to impart a more uniform pattern into the grinding surface of the pulpstone grinding tool and therefore tends to facilitate production of relatively consistent, uniform, and high quality pulp. The burr of this invention may be further advantageous in that its use tends extend the useful service life of pulpstone grinding tools. Other advantages of this invention are discussed in more detail hereinbelow in a further discussion of various embodiments thereof.

Figure 1:
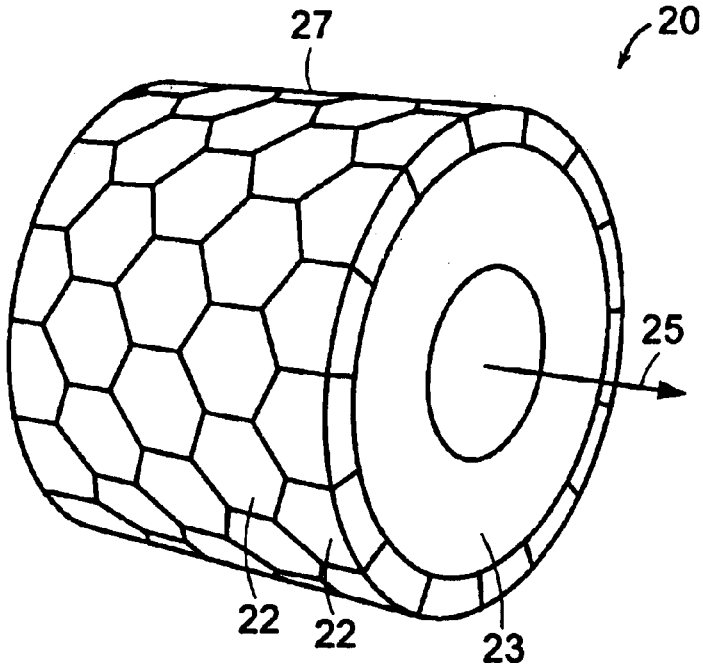
FIG. 1 PRIOR ART
FIG. 1 is a perspective view of one embodiment of a segmented pulpstone grinding tool.

Referring now to FIGS. 1–6B, the prior art and the apparatus and method of the present invention are described. As described briefly hereinabove, and as shown in FIG. 1, a conventional pulpstone grinding tool 20 typically includes a plurality of abrasive segments 22 assembled about a cylindrical concrete core 23, or about some other cylindrical support structure. A typical segment 22 includes a mixture of silicon carbide or aluminum oxide abrasive grains disposed in a matrix of bond material (e.g., vitrified, ceramic, or cement bond). The abrasive grain typically includes a grit size ranging from about U.S. Mesh (Standard Sieve) 24 for relatively course grinding applications, to about U.S. Mesh 80 for relatively fine grinding applications (i.e., grit sizes ranging from about 170 to about 750 microns in diameter). A typical segment 22 further includes a plurality of pores. Segments including a relatively wide range of pore volumes and pore diameters may be used, depending on the particular pulping application.

The grinding surface 27 of a pulpstone grinding tool 20 may be dressed for a number of reasons which include exposing fresh abrasive grains, cleaning or freeing the pores of debris, promoting the movement of water into and pulp out of the grinding zone, and as described briefly hereinabove, to influence wood pulp properties. In one exemplary process, a spiral burr 60 (shown in FIG. 4A and discussed in further detail hereinbelow) is rolled over the surface of a segmented pulpstone grinding tool 20.

Figure 2:
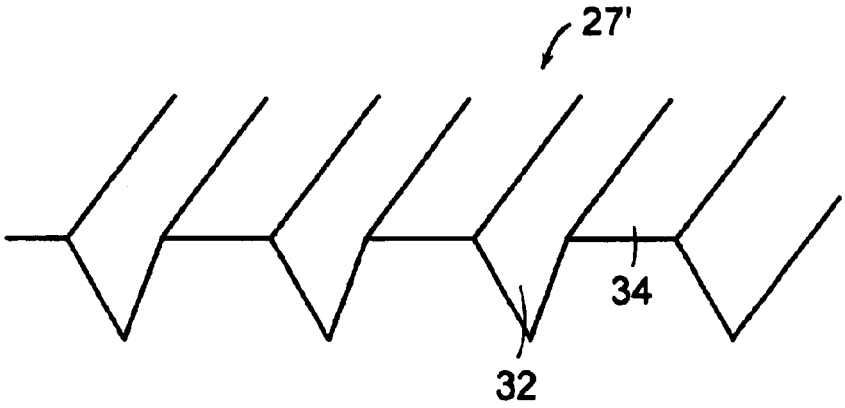
FIG. 2 is a cross sectional schematic of a grinding surface of a pulpstone grinding tool after an exemplary surface dressing operation.
Figure 3:
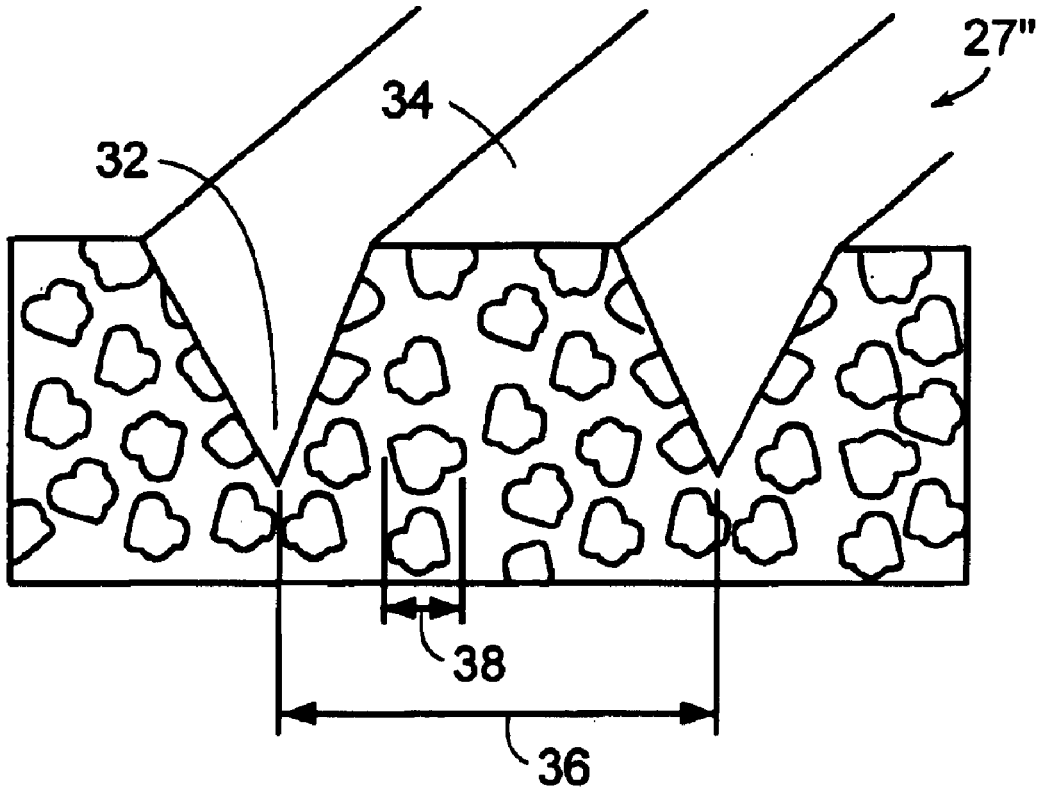
FIG. 3 is a cross sectional schematic of a generally desirable grinding surface of a pulpstone grinding tool after an exemplary surface dressing operation.

Referring now to FIG. 2 in particular, dressing of a pulpstone grinding tool with a spiral burr 60 (FIG. 4*a*) tends to form an alternating pattern of grooves 32 and lands 34 in the grinding surface 27' thereof. During a wood pulping operation, the grooves 32 and lands 34 typically pass rapidly over the surface of the wood resulting in rapid compression and decompression thereof, which causes localized heating and separation of wood fibers from the surface of the wood. A pulpstone grinding surface 27' having relatively narrow lands 34 (i.e., a relatively low percentage of land area) tends to provide for increased localized pressure, and therefore heating, which tends to produce wood pulp having relatively long wood fibers. Conversely, a grinding surface 27' having relatively broad lands 34 (i.e., a relatively high percentage of land area) tends to produce wood pulp having relatively short wood fibers.

Any regrinding of the fibers after separation from the wood also tends to influence the length thereof. For example, pulpstone grinding tools having relatively well-defined and deep grooves 32 tend to produce longer fiber pulp. It is believed that in operation, such deep grooves 32 carry fibers out of the grinding zone to effectively prevent significant regrinding. Fiber length may be further influenced by the angle of the grooves relative to the longitudinal axis 25 of the pulpstone grinding tool 20 (FIG. 1). Increasing the angle tends to lengthen the grinding zone, which promotes regrinding, and therefore, tends to reduce fiber length.

Dressing parameters have also been observed to influence the life of a pulpstone grinding tool. For example, referring to FIG. 3, a generally desirable pulpstone grinding surface 27" may be characterized as including a land width at the base 36 of at least five times that of the average abrasive grain diameter 38. A pulpstone grinding surface having a land width at the base 36 less than five times that of the abrasive grain diameter 38 tends to wear rapidly (i.e., the lands tend to break down owing to the relatively high pressure grinding operation). Excessive wearing tends to necessitate relatively frequent dressing, which tends to slow wood pulp production and shorten the life of the pulpstone grinding tool.

Figure 4A:
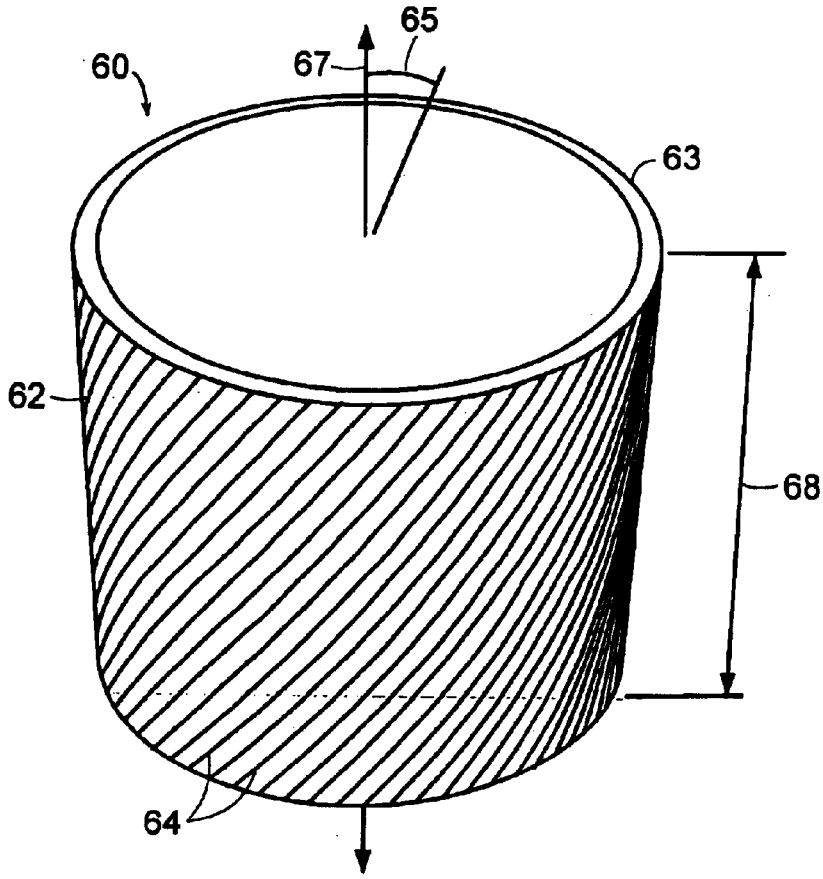
FIG. 4A PRIOR ART
FIG. 4A is a perspective view of one embodiment of a spiral burr dressing tool for dressing the surface of a pulpstone grinding tool, such as that shown in FIG. 1.
Figure 4B:
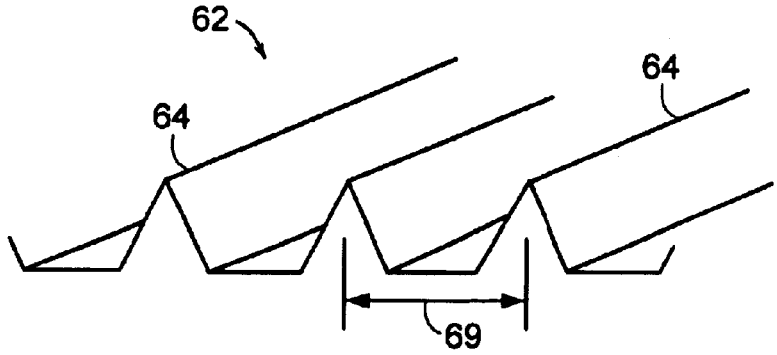
FIG. 4B PRIOR ART
FIG. 4B is a cross sectional schematic of the outer surface of the spiral burr of FIG. 4A.

Referring now to FIGS. 4A and 4B, an exemplary burr 60 (also referred to as a spiral burr) for use in dressing a grinding surface of a pulpstone grinding tool (such as tool 20 in FIG. 1) is illustrated. Burr 60 includes a cylindrical body portion 63, typically in the form of a cylindrical ring, having a plurality of teeth 64 disposed on and protruding from an outer, peripheral surface 62 thereof (also referred to as the working surface). Teeth 64 are typically elongated and extend continuously along the length 68 of the burr 60. The teeth 64 are typically evenly spaced and oriented at a lead angle 65 relative to the longitudinal axis of the burr 60. Burr 60 may include teeth 64 having substantially any spacing, however, the teeth 64 are typically evenly spaced at a distance 69 ranging from about 0.5 to about 6.0 millimeters. Further, lead angle 65 may be substantially any angle in the range from 0 to 90 degrees, but typically is within a range of about 5 to about 75 degrees.

Figure 5:
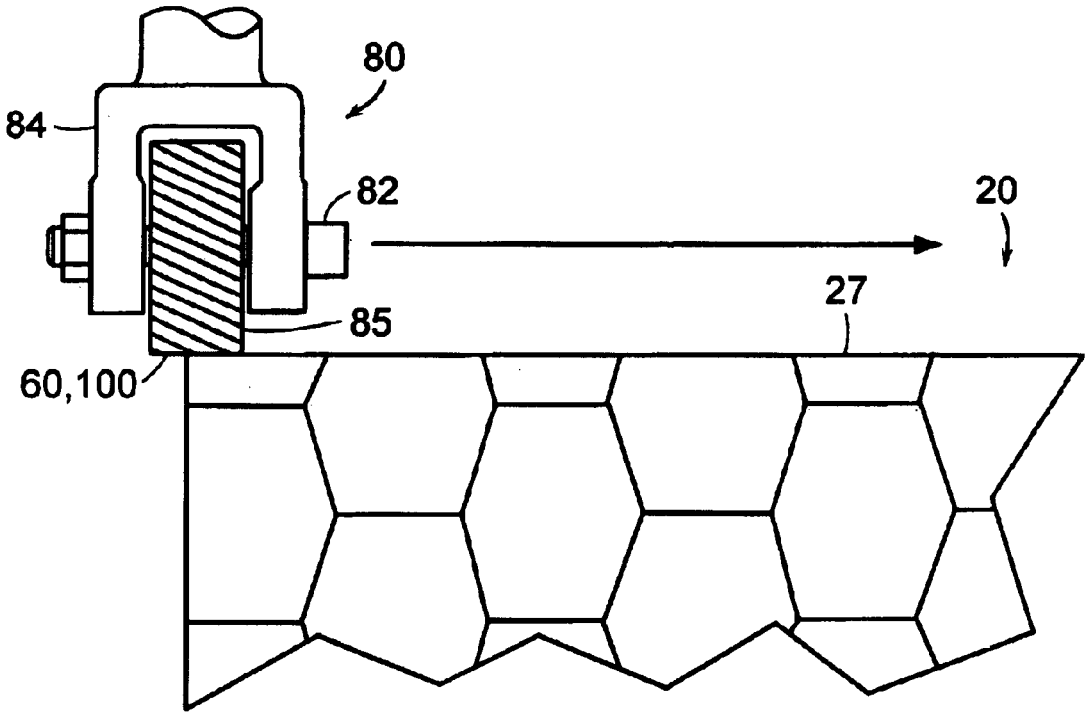
FIG. 5 PRIOR ART
FIG. 5 is a schematic illustrating the use of a spiral burr, such as that shown in FIG. 4A, in dressing a grinding surface of a pulpstone grinding tool, such as that illustrated in FIG. 1.

Referring now to FIG. 5, a spiral burr, such as burr 60 (FIGS. 4A and 4B), is mounted on a burr plug assembly 80, which may include a burr plug (not shown) hydraulically press fit inside the cylindrical burr 60 and rotatably mounted on a burr plug spindle 82, which is further mounted to a lathe fork 84. In one exemplary dressing process, burr 60 is pressed into the pulpstone grinding tool 20 to a controlled penetration depth (typically a depth in the range of from about 0.5 to about 2.5 millimeters). The burr 60 is then traversed axially (i.e., parallel to the longitudinal axis 25) along the length of the pulpstone grinding tool 20, as the tool 20 is rotated about axis 25 (FIG. 1). The burr is thus effectively rolled over the grinding surface 27 of the pulpstone 20, with a traverse speed that is predetermined to permit a relatively small overlap (e.g., 2 to 3 centimeters) of the burr's path for each revolution of the tool 20. In a typical dressing operation the above process is repeated one or more times, with each successive iteration providing for greater radial penetration of the burr 60 into the pulpstone grinding tool 20.

The dressing process described above with respect to FIG. 5 typically produces a pattern of grooves 32 and lands 34 (FIG. 2) in the grinding surface 27, 27', etc., of the pulpstone grinding tool 20. Ideally, this process produces a substantially uniform pattern extending along the (axial) length of the pulpstone grinding tool 20.

One aspect of the present invention is the realization that the teeth of the burr, particularly those at the leading edge 85 thereof, tend to progressively dull (i.e., the cross sections of the teeth become more rounded or sinusoidal in shape) during the traverse. As a result, the pattern at one end of the pulpstone grinding tool 20 may include relatively sharp and deep triangular grooves 32 and relatively flat lands 34, while the opposite end includes relatively rounded and shallow grooves 32 and somewhat rounded lands 34. Since the pattern of grooves 32 and lands 34 are known to influence wood pulp quality (as described hereinabove), the present invention was devised to produce a relatively uniform pattern across the entire grinding surface of the tool 20.

Referring now to FIGS. 6A and 6B, one embodiment of a generally desirable burr 100 is illustrated. Burr 100 is similar to that of burr 60, except that it includes at least one annular channel 110 disposed in the surface 62 thereof. The annular channel(s) 110 separate(s) the grinding surface 62 into at least two, and preferably three or more, discrete surface regions 120. The surface regions 120 typically, but not necessarily, include approximately equal axial (i.e., width) dimensions 122 (i.e., being within about 10% of one another). The annular channel(s) 110 typically each include an axial dimension 112 in the range of from about 1 to about 10 percent (and preferably from about 4 to about 7 percent) of the total axial dimension 102 of the burr 100. In one embodiment, the depth 116 of the annular channel(s) 110 is greater than or about equal to the height (not shown) of the teeth 64'. In another embodiment, the depth 116 of the annular channel(s) 110 ranges from about 20 to about 50 percent of the wall thickness 104 of the cylindrical ring 63. The annular channels may further include chamfered edges 114, which may facilitate engagement of teeth 64' with the pulpstone grinding tool 20.

In embodiments shown and described, channel(s) 110 extend circumferentially, in a direction that is substantially orthogonal to axis 67 (i.e., at a lead angle 65 of 90 degrees). However, the lead angle 65 of channel(s) 110 may be varied, e.g., so that the channel(s) 110 extend in a spiral fashion along surface 62 of the burr, without departing from the spirit and scope of the present invention.

Burr 100 may include teeth 64' having substantially any geometry known to those skilled in the art, including for example, individual diamond-shaped protrusions. However, in various embodiments, teeth 64' are similar to those shown and described hereinabove with respect to burr 60 (FIGS. 4A and 4B). For example, teeth 64' typically include triangular cross sections (such as that shown in FIG. 4B) and are elongated to extend the full axial dimension of the surface region 120 upon which they are disposed.

Burr 100 may be used in a substantially similar manner that of burr 60 in dressing the grinding surface 27, 27', etc., of a pulpstone grinding tool 20 (as described hereinabove with respect to FIG. 5). Burr 100 is advantageous in that it tends to have a greater resistance to dulling than that of burr 60. In one sense, the increased resistance to dulling is counterintuitive since the channel(s) 110 in burr 100 effectively reduce the area of the cutting surface 62 (e.g., by about 12 percent in an embodiment including two channels 110, each with an axial dimension 112 of about six percent of the total axial dimension 102 of the burr). Nevertheless, burr 100 tends to produce a more uniform pattern of grooves 32 and lands 34 (FIG. 2) along the grinding surface 27 of a pulpstone grinding tool 20 (FIGS. 1 and 5), and therefore, may provide for an improved quality wood pulp as described in further detail hereinbelow with respect to Example 3. Not wishing to be constrained by a particular theory, it is believed that the teeth 64, 64' are dulled first and foremost at the leading edge 85 of the burr (see FIG. 5). Forming one or more annular channels 110 into the surface 62 of the burr separates it into two or more surface regions 120 (as described hereinabove), each of which may be thought of as including a leading edge. Burr 100 may therefore be thought of as including two or more leading edges, which tends to advantageously distribute the forces that dull the teeth 64'. As a result, dulling of the burr 100 tends to be ameliorated, to produce a more uniform pattern of grooves 32 and lands 34 along the length of a pulpstone grinding tool 20.

EXAMPLE 1

Experimental burrs were fabricated according to the principles of the present invention in order to evaluate the performance thereof. The experimental burrs were similar to the commercially available 6×28 spiral burr (available from Norton Canada, Inc., Hamilton, Ontario, Canada) in that they included a cylindrical ring having an axial dimension of about 73 mm and an outer diameter of about 111 mm. The teeth were oriented at a lead angle of about 28 degrees and spaced at a pitch of about 6 teeth per inch (i.e., a spacing of about 4.2 mm). The experimental burrs of this example differed from the commercially available 6×28 spiral burr in that they included two annular channels 110, substantially as shown and described with respect to FIG. 6A hereinabove, each having an axial dimension (width) of about 4 mm and a depth of about 2.2 mm. The channels were spaced in a manner providing for three surface regions, each having an axial dimension of about 22 mm.

EXAMPLE 2

Experimental burrs (referred to herein as Burr 2-A), fabricated according to the parameters of Example 1, were utilized to dress the grinding surface of a pulpstone grinding tool (model number A701N7VG, having an axial dimension of about 90 inches (2290 mm), available from Norton Canada, Inc., Hamilton, Ontario, Canada). For comparative purposes, commercially available 6×28 spiral burrs were used to dress the grinding surface of another pulpstone grinding tool (also model number A701N7VG). Prior to dressing, the pulpstones were each trued in a conventional manner using a No. 12 diamond burr (available from Norton Canada, Inc.).

The dressing process used in this Example was similar to that described hereinabove with respect to FIG. 5. A first burr was pressed into the grinding surface of the pulpstone grinding tool to a penetration depth of 0.02 inches (0.5 mm) beyond the spark point and then traversed axially along the length thereof. The first burr was then discarded and a second burr pressed to a penetration depth of 0.03 inches (0.76 mm) and similarly traversed. The second burr was then discarded and a third burr was pressed to a penetration depth of 0.04 inches (1.0 mm) and similarly traversed. The third burr was then discarded and a fourth burr was pressed to a penetration depth of 0.045 inches (1.1 mm) and similarly traversed. Prior to initiating the dressing process, the traverse speed was calculated using the following formula:

$$BT=(60\times Ws)\times 0.90/(Ss\times Wb)$$

BT=Burr Traverse Speed in Seconds

Ws=Axial Length of Pulpstone

Ss=Rotation rate of Pulpstone in RPM

Wb=Length of Burr

The calculated traverse speed allows for approximately 1 inch (25 mm) overlap of the burr for each revolution of the pulpstone. Specific dressing process conditions were as follows:

| Dressing Process Conditions: | |
|---|---|
| Pulpstone Grinding Tool: | Model No. A701N7VG |
| Burr Specifications: | Burr 2-A |
| | Norton Canada, Inc., 6 × 28 (comparative) |
| Burr Traverse Time | 5.2 seconds |
| Pulpstone Rotation Rate | 327 RPM |
| Pulpstone Length | 90 inch (2290 mm) |
| Burr Length (Axial) | 2 ⅞ inch (73 mm) |
| Lead Angle | 28 degrees |
| Pitch | 6 teeth per inch (4.2 mm per tooth) |
| Penetration Depth: | Burr 1: 0.020 inch (0.5 mm) |
| | Burr 2: 0.030 inch (0.76 mm) |
| | Burr 3: 0.040 inch (1.0 mm) |
| | Burr 4: 0.045 inch (1.1 mm) |

Visual examination of the burrs after each traverse indicated that the experimental burrs were more resistant to dulling than the comparative burrs. In particular, the teeth at the leading edge of the comparative burr were more rounded than those at the leading edge of the experimental burrs.

Visual examination of the grinding surfaces of the pulpstone grinding tools revealed that the tool dressed using the experimental burrs included a more uniform pattern of grooves and lands along its length than that of the tool dressed using the comparative burrs. In particular, the grooves and lands were relatively sharp and well defined at both ends of the tool dressed with the experimental burrs. Contrariwise, the tool dressed with the comparative burrs included relatively sharp and defmed grooves and lands at one end (at the traverse start) and relatively rounded and more shallow grooves at the other end (at the traverse end).

EXAMPLE 3

Pulpstone grinding tools prepared according to Example 2 were utilized to produce wood pulp. The grinding test conditions were as follows:

| Pulp Grinding Conditions: | |
|---|---|
| Pulpstone Grinding Tool: | A701N7VG |
| Pulpstone 1 dressed with experimental burr (Burr 2-A) | |
| Pulpstone 2 dressed with comparative burr (Burr 6 × 28) | |
| Pulpstone Length | 90 inch (2290 mm) |
| Pulpstone Rotation Rate | 327 RPM |
| Grinding Pressure | About 300 psi (2.1 MPa) |
| Shower Water Pressure | 85–90 psi (580–620 kPa) |
| Shower Flow Rate | 125 gal/min (475 liter/min) |
| Wood Type: | Spruce |

Results of the grinding test of Example 3 are shown below in Table 1. The pulpstone grinding tool dressed using the experimental burr of this invention (Burr 2-A) was observed to produce wood pulp having highly desirable physical properties. The pulpstone grinding tool dressed using the experimental burrs was observed to grind wood pulp at a more stable temperature (i.e., in the range of about 180–190 degrees F.) than that of the pulpstone dressed using the comparative burrs (i.e., within the conventional range of about 175–195 degrees F.), indicating the production of wood pulp having a more uniform quality. Further, the pulpstone grinding tool dressed using the experimental burr produced wood pulp having a fiber strength greater than that of the pulpstone grinding tool dressed using the comparative burr (i.e. 4100 m verses 3900 m as measured by the industry standard Tensile, Elongation, Analysis (TEA) Test). Since fiber strength is a well known indicator of fiber quality, it may be concluded that the experimental burr provides for an improved quality wood pulp. Further still, the pulpstone grinding tool dressed using the experimental burr produced wood pulp having improved pulp brightness as compared to that of the pulpstone grinding tool dressed using the comparative burr (i.e. 64 versus 63 as measured by the industry standard ISO Brightness Test.

In summary, dressing the grinding surface of a pulpstone grinding tool using the experimental burr of this invention provides for wood pulp of both an improved and a more uniform quality as compared to pulpstones dressed with the comparative (conventional) burr. The performance of the experimental burr may provide for significant cost savings for a typical pulp mill. The improved brightness of the wood pulp produced using the pulpstone dressed using the burr of this invention may provide for significant savings in wood pulp bleaching chemicals.

TABLE 1

| Pulp Property | Experimental Burr | Comparative Burr |
|---|---|---|
| Grinder Temperature | Highly Stable | Moderately Stable |
| Fiber Strength (TEA test) | 4100 m | 3900 m |
| Pulp Brightness (ISO standard test) | 64 | 63 |

The foregoing Examples and description are intended primarily for the purposes of illustration. Although the invention has been described according to an exemplary embodiment, it should be understood by those of ordinary skill in the art that modifications may be made without departing from the spirit of the invention. The scope of the invention is not to be considered limited by the description of the invention set forth in the specification or example, but rather as defined by the following claims.

The modifications to the various aspects of the present invention described hereinabove are merely exemplary. It is understood that other modifications to the illustrative embodiments will readily occur to persons with ordinary skill in the art. All such modifications and variations are deemed to be within the scope and spirit of the present invention as defmed by the accompanying claims.

What is claimed is:

1. A burr adapted for dressing a grinding surface of a grinding tool, said burr comprising:

a cylindrical body portion having an outer surface;

a plurality of teeth protruding radially outward from said outer surface;

the plurality of teeth extending helically along said outer surface; and at least one annular channel extending transversely to the longitudinal axis along said outer surface;

said burr configured for dressing a grinding surface of a pulpstone grinding tool and said pulpstone grinding tool is adapted for mechanical preparation of wood pulp.

2. A burr for dressing a grinding surface of a pulpstone grinding tool adapted for mechanical preparation of wood pulp, said burr comprising:

a cylindrical body portion having an outer surface, a longitudinal axis, and an axial dimension;

a plurality of teeth protruding radially outward from said outer surface;

the plurality of teeth extending helically along said outer surface;

at least one annular channel extending transversely to the longitudinal axis along said outer surface; and said burr being configured for dressing a grinding surface of a pulpstone grinding tool adapted for mechanical preparation of wood pulp.

3. The burr of claim 2 wherein said outer surface comprises at least two grinding surface regions separated from one another by said at least one annular channel.

4. The burr of claim 3 wherein said at least two grinding surface regions include substantially equal axial dimensions.

5. The burr of claim 2 wherein said at least one annular channel has an axial dimension ranging from about 1 to about 10 percent of the axial dimension of said cylindrical body portion.

6. The burr of claim 5 wherein said at least one annular channel has an axial dimension ranging from about 4 to about 7 percent of the axial dimension of said cylindrical body portion.

7. The burr of claim 2 wherein said plurality of teeth are elongated.

8. The burr of claim 7 wherein said plurality of teeth comprise a substantially triangular cross section.

9. The burr of claim 7 wherein said plurality of teeth extend continuously along the axial dimension of a surface region upon which they are disposed.

10. The burr of claim 7 wherein said teeth have a spacing ranging from about 0.5 to about 6.0 millimeters.

11. The burr of claim 2, wherein said plurality of teeth are elongated; and said plurality of teeth extend in a direction offset from the longitudinal axis by a lead angle ranging from about 5 to about 75 degrees.

12. The burr of claim 11 wherein the lead angle ranges from about 20 to about 50 degrees.

13. The burr of claim 2 wherein said plurality of teeth have a substantially pyramidal shape.

14. A burr for dressing a grinding surface of a pulpstone grinding tool adapted for mechanical preparation of wood pulp, said burr comprising:

a cylindrical body portion having an outer surface, a longitudinal axis, and an axial dimension;

a plurality of teeth protruding radially outward from said outer surface;

the plurality of teeth extending helically along said outer surface;

at least two annular channels disposed in said outer surface; and said burr being configured for dressing a grinding surface of a pulpstone grinding tool adapted for mechanical preparation of wood pulp.

15. The burr of claim 14 comprising three grinding surface regions.

16. A burr for dressing a grinding surface of a pulpstone grinding tool adapted for mechanical preparation of wood pulp, said burr comprising:

a cylindrical body portion having an outer surface, a longitudinal axis, and an axial dimension;

a plurality of teeth protruding radially outward from said outer surface;

the plurality of teeth extending helically along said outer surface;

at least one annular channel disposed in said outer surface;

said burr being configured for dressing a grinding surface of a pulpstone grinding tool adapted for mechanical preparation of wood pulp; and wherein said at least one annular channel includes a radial depth dimension greater than or about equal to a radial height dimension of said teeth, said depth dimension and said height dimension being substantially perpendicular to said longitudinal axis.

17. A burr for dressing a grinding surface of a pulpstone grinding tool adapted for mechanical preparation of wood pulp, said burr comprising:

a cylindrical body portion having an outer surface, a longitudinal axis, and an axial dimension;

a plurality of teeth protruding radially outward from said outer surface;

the plurality of teeth extending helically along said outer surface;

at least one annular channel disposed in said outer surface;

said burr being configured for dressing a grinding surface of a pulpstone grinding tool adapted for mechanical preparation of wood pulp; and wherein said cylindrical body portion comprises a cylindrical ring having a radial thickness dimension, wherein said at least one annular channel includes a radial depth ranging from about 20 to about 50 percent of said radial thickness of said cylindrical ring.

18. A burr for dressing a grinding surface of a pulpstone grinding tool, said burr comprising:

a cylindrical ring having an outer surface, a longitudinal axis, and an axial dimension;

two annular channels disposed in said outer surface, said two annular channels dividing said outer surface into three surface regions having approximately equal axial dimensions, each of said two annular channels including an axial dimension ranging from about 1 to about 10 percent of the axial dimension of the cylindrical ring;

a plurality of elongated teeth protruding radially outward from said outer surface, said plurality of elongated teeth including substantially triangular cross sections and extending in a direction offset from said longitudinal axis by a lead angle ranging from about 5 to about 75 degrees; and said burr being useful for dressing a grinding surface of a pulpstone grinding tool.

19. A method of dressing a grinding surface of a pulpstone grinding tool adapted for mechanical preparation of wood pulp, said method comprising:

providing a burr including:

a cylindrical body portion having an outer surface;

a plurality of teeth disposed on and protruding from the outer surface;

the teeth extending helically along the outer surface;

at least one annular channel disposed in the outer surface;

rotatably mounting the burr on an assembly adapted to traverse the axial dimension of the pulpstone grinding tool;

pressing the burr into contact with the grinding surface of the pulpstone grinding tool;

rotating the pulpstone grinding tool, wherein the burr rolls over the grinding surface of the tool; and traversing the burr along the axial dimension of the pulpstone grinding tool.

20. A method of preparing wood pulp comprising:

providing a burr including:

a cylindrical body portion having an outer surface;

a plurality of teeth extending from the outer surface;

the teeth extending helically along the outer surface;

at least one annular channel disposed in the outer surface;

rotatably mounting the burr on an assembly adapted to traverse the axial dimension of the pulpstone grinding tool;

pressing the burr into contact with the grinding surface of the pulpstone grinding tool;

rotating the pulpstone grinding tool, wherein the burr rolls over the grinding surface thereof;

traversing the burr along the axial dimension of the pulpstone grinding tool; and using the pulpstone grinding tool to mechanically grind wood into wood pulp.

* * * * *